US007246452B1

(12) United States Patent
Roy

(10) Patent No.: US 7,246,452 B1
(45) Date of Patent: Jul. 24, 2007

(54) METHOD FOR TREATING PRESERVATIVE-TREATED WOOD

(76) Inventor: Jacques Roy, 2389 Maritain Québec, Québec (CA) G1T 1N6

( * ) Notice: Subject to any disclaimer, the term of this patent is extended or adjusted under 35 U.S.C. 154(b) by 0 days.

(21) Appl. No.: 10/869,883
(22) Filed: Jun. 18, 2004

Related U.S. Application Data

(60) Provisional application No. 60/479,842, filed on Jun. 20, 2003.

(51) Int. Cl.
*F26B 7/00* (2006.01)

(52) U.S. Cl. ..... 34/396; 34/381; 427/317; 427/325; 427/393

(58) Field of Classification Search ..... 34/381, 34/391, 393, 396, 428, 468, 471, 474, 475; 427/317, 325, 393
See application file for complete search history.

(56) References Cited

U.S. PATENT DOCUMENTS

| | | | | |
|---|---|---|---|---|
| 5,871,817 | A * | 2/1999 | Nasheri | 427/317 |
| 6,374,513 | B1 * | 4/2002 | Unternhahrer et al. | 34/396 |
| 6,426,118 | B2 | 7/2002 | Barnisin, Jr. | |
| 6,473,994 | B1 * | 11/2002 | Dedieu et al. | 34/396 |

* cited by examiner

*Primary Examiner*—Jiping Lu

(57) ABSTRACT

There is provided a method for treating preservative-treated wood such that the preservative is substantially prevented from leaching. The treatment comprises drying of the preservative-treated wood until the moisture content of the wood is below a level capable of supporting the diffusion of the preservative.

10 Claims, No Drawings

METHOD FOR TREATING PRESERVATIVE-TREATED WOOD

CROSS-REFERENCE TO RELATED APPLICATIONS

This application claims priority on U.S. provisional application 60/479,842 filed on Jun. 20, 2003 and entitled "Method for treating preservative-treated wood". This application is related to U.S. Pat. No. 6,374,513, the content of which is incorporated herein by reference.

TECHNICAL FIELD

The invention relates to a method for treating preservative-treated wood and more specifically, the invention relates to heat treatment of the preservative-treated wood for enhancing the retention of preservatives.

BACKGROUND OF THE INVENTION

Unprotected wood structures are susceptible to degradation by fungi and insects such as termites, which can cause substantial damage to wood building structures. Property damage in US alone is estimated to be in the neighborhood of 1 billion dollars a year. Various processes and chemicals have been used to treat wood to protect it from insect degradation. For example, preservatives, such as Copper Chrome Arsenate (CCA), ACC, ACQ and borate, have been impregnated in wood by a variety of processes. One popular method of integrating chemicals in the wood is by a vacuum/pressure treatment in the presence of an aqueous solution containing the preservative.

While the known methods are relatively successful at introducing preservatives in wood products, the resulting product is very prone to wash out by exposure to water. In particular, borate treated lumber is particularly prone to wash-out by rain water and cannot be used in exterior structures. Methods have been developed to attempt preventing the leaching out of preservatives. One such method is described in U.S. Pat. No. 6,426,118 to Barnisin. The method consists in drying the wood before infusing the preservative followed by further drying and the infusion of a waxy solid that constitutes a barrier to water and prevent leaching of the active ingredient. This method suffers from the need to treat the wood with not only the active ingredient but also the waxy solid which makes the treatment longer and more costly. Furthermore the wax may adversely affect further treatment of the wood with coatings such as paint.

Another example is provided in Du Fresne et al. U.S. Pat. No. 3,306,765 which teaches the addition of carbon dioxide under pressure to borate treated wood to fix fireproofing agents. This method requires chemical treatment in addition to borate treatment which increases the cost of treatment and may impact the mechanical property of wood.

Therefore, there is need for a better process for preventing preservatives leaching out of wood.

SUMMARY OF THE INVENTION

The invention relates to a method for treating wood with wood preservatives and more specifically, the invention relates to heat treatment of the wood for fixing wood preservatives.

There is provided a method for treating preservative-treated wood so as to prevent the leaching out of the preservative from wood used in exterior structures. In particular the method is useful in preventing the leaching of borate from borate-treated wood exposed to water, such as rain water, thereby providing a wood composition that is substantially permanently protected from wood destroying fungi and insects such as termites.

The method comprises the removal of moisture from the preservative-treated wood until the level of moisture is below that supporting the diffusion of the preservative within a given wood species.

Further features and advantages of the present invention will become apparent from the following detailed description.

DETAILED DESCRIPTION OF THE PREFERRED EMBODIMENT

The present invention provides a method whereby lignocellulosic material, such as wood, is treated with a wood preservative and dried to provide a wood-preservative composition that is resistant to the leaching of the preservative under external conditions such as rain.

The wood is treated with a wood preservative to produce wood having a desired concentration of preservative. The wood is then dried to reduce the moisture content below a level necessary to support diffusion of the preservative within the wood. It will be appreciated that the wood maybe dried to a certain extent prior to treatment with the preservative provided that the moisture content remains equal or above a level necessary to support the diffusion of the preservative within the wood.

Treatment of the wood with a preservative can be accomplished using processes known in the art. The processes may comprise the use of vacuum/pressure treatment such as those described, for example, in U.S. Pat. Nos. 6,250,350 and 6,235,403 incorporated herein by reference. However, the person skilled in the art will appreciate that other well known treatment methods can also be used.

The preservative-treated wood is dried to a moisture content below that which is necessary to support diffusion of the preservative within the wood. In general, simple removal of "free" water is not sufficient to achieve this goal. Thus, in one aspect of the present invention the moisture content of the wood fiber is reduced below the moisture content necessary to support diffusion of the preservative. The overall moisture content of the preservative-treated wood should be, without being limited to, between about 0 and 10% and more preferably between about 0 and 5% and the end of the drying process.

It will be appreciated that the moisture content capable of supporting diffusion of the preservative may depend on the species of the wood being treated. Accordingly, the drying process and the extent of drying is adjusted as a function of the wood species.

The method is particularly useful for anhydride and/or salt-based preservatives or any preservatives that would be susceptible to leaching out of the wood as a result of the presence of water. In a preferred embodiment borate is used at concentrations sufficient to destroy or prevent the growth of certain wood destroying fungi and insects such as termites and beetles. In a preferred embodiment final concentrations of between 2 and 5 $kg/m^3$ and more preferably, between 2.7 and 4.5 $kg/m^3$ are used. Various forms of borate can be used, such as borate salts which may include but are not limited to disodium octaborate tetrahydrate.

The drying of the preservative-treated wood to reduce the moisture content below the level necessary to support diffusion of the preservative within the wood may be achieved using various known drying methods. These methods may comprise for example steps in which the wood is dried using water vapors as a heat conductor and in which the drying is performed in oxygen depleted atmosphere (by replacing oxygen with another gas such as nitrogen).

In a preferred embodiment the present invention is carried out using the method described in U.S. Pat. No. 6,374,513 which is incorporated herein by reference.

The method comprises a pre-heating step that removes substantially all the free water contained in the wood. This drying step is followed by a second drying step at higher temperature, which reduces the moisture level within the wood below a level necessary for diffusion of the preservative.

The heating steps while they can be performed in any suitable treatment chamber are preferably performed using a chamber as described in U.S. Pat. No. 6,374,513.

Thus, the first step in the treatment consists in pre-heating the preservative-treated wood up to a drying temperature $\theta_1$. This temperature is sufficient to ensure the free water contained in the material evaporates, and is for example comprised between 100 and 120° C., preferably around 105° C. The duration T1 of this pre-heating step depends on the thickness and nature of the material to be treated.

Once the drying temperature $\theta_1$ has been reached, drying of the material is performed by maintaining this same temperature value, or a temperature substantially close to this, for a time T2 until such time as all of the water contained in the material has practically all evaporated.

The next step can be initiated when the free water content in the material has been practically all evaporated, for example when the degree of humidity, measured at the chimneys for example, is comprised between 10 and 20%, preferably 12%. This value is sufficient to ensure that subsequent treatment of the material proceeds correctly.

The duration T2 of the drying phase further depends on the nature of the material to be treated, on the quantity of free water that it contains as well as the dimensions of the material. The duration can be zero where the material is very dry at the outset, the free water then being evaporated during the pre-heating step.

Next, a step in which dried material is heated is performed by raising the temperature up to a target value $\theta_2$. This temperature again depends on the nature of the material to be treated, and is typically comprised between 200 and 240° C. It can be close to 220° C. For certain foliaceous species, such as chestnut or close to 230° for resinous woods, such as Douglas pine. The temperature rise can be controlled by using any useful temperature sensor means. The duration T3 of this heating step is not determined in advance, but again depends on the nature of the material, its thickness, and on the charge inside the treatment chamber. During this step, the residual water vapor and burned gases are preferably discharged from the treating chamber. The degree of oxygen inside the treatment apparatus is preferably limited, so that the burner operates in a reducing atmosphere. The heated material may give off a combustible mixture, which is preferably burnt in a combustion chamber. One avoids thereby any danger of the material catching fire.

At the end of this heating step, it can be arranged to maintain the material at the target temperature value $\theta_2$.

Without wishing to be limited by theory the drying steps produce a progressive drying that favors a directional drying of the wood from the exterior to the heart. It is likely that this progressive, directional drying favors the penetration of wood preservatives by creating a water concentration gradient from the exterior to the heart of the wood.

Following this, the material is cooled. In one embodiment, and referring to the combustion chamber described in U.S. Pat. No. 6,374,513, using the burner, water is sprayed into the combustion chamber. The effect of this is to decrease the temperature in the treatment chamber without this creating any thermal shock. Additionally, this ensures more homogeneous cooling of the material than would be the case if one were to spray the water directly into the treatment chamber. Cooling is continued until the temperature inside the material, measured by a mobile sensor or sensors, is lower than a third temperature $\theta_3$, limiting the risk of the material catching fire upon leaving the treatment chamber. In practice, a temperature of around 80° C. is sufficient. During the whole of this cooling step, the extraction chimneys give off water vapor. A throughput of a quarter of a liter of water every 15 seconds provides effective cooling for the cell dimensions given above. From the moment where the temperature $\theta_3$ within the material has dropped to around 120° C., cooling is continued without injecting water vapor, by simply mixing the gases within the treatment chamber. During the cooling step, the temperature within the material to be treated becomes higher than the outside temperature. Cooling can be controlled simply by controlling the amount of water injected.

To take the example of the treatment of wooden planks of 120×27 mm cross section in a foliaceous wood such as oak, the following parameters can be employed:

$\theta_1$=120° C.; $\theta_2$=220° C.; $\theta_3$=100° C.; $\delta$=20–40° C.

Treatment is carried out with the following durations:

T1=5–8 hours; T2=1–4 hours; T3=2–6 hours;

T4=15–45 minutes.

For treating 120×27 mm cross-section planks in wood such as Douglas pine, the following parameters can be employed:

$\theta_1$=120° C.; θ2=230° C.; $\theta_3$=80° C.; $\delta$=20–30° C.

Treatment is performed with the following durations:

T1=4–7 hours; T2=2–3 hours; T3=1–5 hours;

T4=15–45 minutes.

It will be appreciated that the treatment as described above can confer fire retardant properties to the treated wood.

In another embodiment of the invention there is also provided compositions comprising wood and one or more preservative and in which the moisture content is below the level supporting diffusion of the preservative in the wood such as can be obtained using the method described above. The wood included in the composition may consist of but is not limited to structural wood, laminated wood, fibre wood panels, plywood and the like.

The embodiment(s) of the invention described above is (are) intended to be exemplary only.

I claim:

1. A method for treating preservative-treated wood, said method comprising:

providing preservative-treated wood containing a borate preservative;

preheating said preservative-treated wood at a temperature close to a vaporization temperature of free water;

heat-treating said preservative-treated wood until a moisture content of said preservative-treated wood is less than 1% which is below a level supporting diffusion of said borate preservative within said wood whereby leaching of said borate preservative from said wood is inhibited; and cooling said preservative-treated wood.

2. The method according to claim 1, wherein the preheating is continued until substantially all free water contained in said wood has evaporated.

3. The method according to claim 1, wherein the step of heat-treating said wood is carried out at a temperature between 200 and 240° C.

4. The method according to claim 1, wherein the step of heat-treating said wood is followed by a step in which said wood is maintained at a temperature close to the temperature during said heat-treating step.

5. The method according to claim 1, wherein a substantial difference between the temperature external of said wood and the temperature within said wood is maintained during the steps of pre-heating and heat-treating.

6. The method according to claim 1, wherein said preheating step is continued until the humidity of gases around said material is about 12%.

7. The method as claimed in claim 1 wherein said moisture content is less than 0.5%.

8. The method as claimed in claim 1 wherein said moisture content is close to 0%.

9. The method according to claim 1, wherein said borate preservative is a borate salt.

10. The method as claimed in claim 9 wherein said borate salt is disodium octaborate tetrahydrate.

* * * * *